United States Patent [19]

Buchanan et al.

[11] Patent Number: 5,019,492

[45] Date of Patent: May 28, 1991

[54] PHOTOGRAPHIC ELEMENT AND PROCESS COMPRISING A BLOCKED PHOTOGRAPHICALLY USEFUL COMPOUND

[75] Inventors: John M. Buchanan; Ewell R. Cook; Jared B. Mooberry; Gary S. Proehl, all of Rochester; Stephen P. Singer, Spencerport, all of N.Y.; William N. Washburn, LaJolla, Calif.

[73] Assignee: Eastman Kodak Company, Rochester, N.Y.

[21] Appl. No.: 343,981

[22] Filed: Apr. 26, 1989

[51] Int. Cl.[5] ..... G03C 7/305

[52] U.S. Cl. ..... 430/543; 430/218; 430/219; 430/222; 430/223; 430/544; 430/559; 430/607; 430/610; 430/611; 430/598; 430/621; 430/955; 430/956; 430/957; 430/958; 430/959; 430/960

[58] Field of Search ..... 430/955, 956, 957, 958, 430/959, 960, 598, 543, 544, 559, 607, 610, 611, 218, 219, 222, 223; 436/621

[56] References Cited

U.S. PATENT DOCUMENTS

| | | | |
|---|---|---|---|
| 4,248,962 | 3/1981 | Lau | 430/382 |
| 4,263,393 | 4/1981 | Chen | 430/218 |
| 4,283,472 | 8/1981 | Gompf et al. | 430/17 |
| 4,310,612 | 1/1982 | Mooberry et al. | 430/223 |
| 4,358,525 | 11/1982 | Mooberry et al. | 430/217 |
| 4,409,323 | 10/1983 | Sato et al. | 430/544 |
| 4,446,216 | 5/1984 | Smith et al. | 430/405 |
| 4,554,243 | 11/1985 | Ono et al. | 430/543 |
| 4,629,683 | 12/1986 | Itoh et al. | 430/390 |
| 4,690,885 | 9/1987 | Yagihara | 430/219 |
| 4,737,442 | 4/1988 | Yagihara et al. | 430/264 |
| 4,772,537 | 9/1988 | Itoh et al. | 430/219 |
| 4,857,440 | 8/1989 | Begley et al. | 430/382 |

FOREIGN PATENT DOCUMENTS 0255085 2/1988 European Pat. Off. .

*Primary Examiner*—Charles L. Bowers, Jr.
*Assistant Examiner*—Lee C. Wright
*Attorney, Agent, or Firm*—Richard E. Knapp

[57] ABSTRACT

A novel blocked photographically useful compound comprises a new blocking group that (a) comprises two electrophilic groups, the least electrophilic of which is bonded directly or through a timing group to the photographically useful group (PUG) of the compound, (b) is capable of reacting with a dinucleophile reagent, and (c) has the two electrophilic groups separated from each other by a bond or unsubstituted or substituted atom that enables nucleophilic displacement to occur with release of PUG when the compound is reacted with a dinucleophile reagent. Such a blocked photographically useful compound is useful in a photographic material and process to provide increased stability and enable more rapid release of the photographically useful group upon reaction with a dinucleophile reagent.

8 Claims, No Drawings

PHOTOGRAPHIC ELEMENT AND PROCESS COMPRISING A BLOCKED PHOTOGRAPHICALLY USEFUL COMPOUND

This invention relates to a new blocked photographically useful compound that is capable of more rapidly releasing the photographically useful group of the compound upon reaction of the compound with a dinucleophile reagent.

Various compounds, such as couplers and dyes, are known in the photographic art that contain a blocking group and that are capable of being released or unblocked upon processing of the photographic material containing the compound. Such compounds and various blocking groups have been described in, for example, U.S. Pat. Nos. 4,690,885; 4,358,525 and 4,554,243. While these compounds have enabled increased storage stability compared to compounds that are not blocked and have provided release of the photographically useful group from the compound upon processing, often the stability of the compounds during storage prior to exposure and processing of the photographic materials containing the compounds has not been entirely satisfactory and the rate of release or unblocking of the compound has been less than desired.

A need has existed for a blocked photographically useful compound containing a blocking group that enables increased storage stability in a photographic material and enables increased rate of release or unblocking during processing of the photographic material without adverse effects upon a photographic material containing such a compound.

The present invention solves these problems by providing a photographic element comprising a support bearing at least one photographic silver halide emulsion layer and a blocked photographically useful compound comprising a photographically useful group (PUG) and a new blocking group that is capable of releasing the PUG upon processing the photographic element wherein the blocking group (a) comprises two electrophilic groups, the least electrophilic of which is bonded directly or through a timing group to the photographically useful group (PUG); (b) is capable of reacting with a dinucleophile; and, (c) the two electrophilic groups are separated from each other by a bond or unsubstituted or substituted atom that enables a nucleophilic displacement reaction to occur with release of PUG upon processing the photographic element in the presence of a dinucleophile reagent.

A preferred blocked photographically useful compound as described is represented by the formula:

$$[E_1(Y^1)_wE_2-(T_1)_x-(T_2)_y]_n-PUG$$

wherein $E_1$ and $E_2$ are independently electrophilic groups, wherein $E_1$ is more electrophilic than $E_2$;

$T_1$ and $T_2$ are individually releasable timing groups;

$Y^1$ is unsubstituted or substituted atom, preferably a carbon or nitrogen atom, that provides a distance between $E_1$ and $E_2$ that enables a nucleophilic displacement reaction to occur with release of PUG upon processing a photographic element containing the blocked photographically useful compound in the presence of a dinucleophile;

PUG is a photographically useful group capable of being released upon processing the photographically useful compound;

w, x and y are independently 0 or 1; and, n is 1 or 2.

An illustrative blocked photographically useful compound within the above formula is represented by the formula:

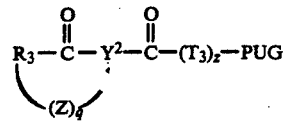

wherein $R_3$ is unsubstituted or substituted alkyl, unsubstituted or substituted aryl, or the atoms necessary with Z to complete a ring, particularly an alicyclic or heterocyclic ring, with $Y^2$;

Z represents the atoms necessary to complete a ring with $R_3$ and $Y^2$ $Y^2$ is a substituted or unsubstituted carbon or nitrogen atom that provides a distance between the carbonyl groups that enables a nucleophilic displacement reaction to occur upon processing a photographic element containing the blocked photographically useful compound in the presence of a dinucleophile;

q and z are independently 0 or 1;

$T_3$ is a releasable timing group; and,

PUG is a photographically useful group.

Highly preferred blocked photographically useful compounds are represented by the formulas:

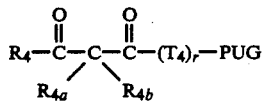

and

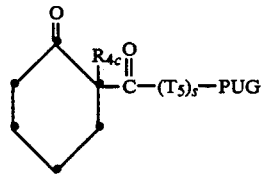

wherein $R_{4a}$, $R_{4b}$ and $R_{4c}$ individually are unsubstituted or substituted alkyl or unsubstituted or substituted aryl; PUG is a photographically useful group; $T_4$ and $T_5$ are individually releasable timing groups; and r and s individually are 0 or 1. $R_{4a}$, $R_{4b}$ and $R_{4c}$ are preferably methyl.

The blocking group as described can contain a ballast group. Ballast groups known in the photographic art can be used for this purpose.

One embodiment of the invention is a photographic element comprising a blocked photographically useful compound containing the new blocking group as described. Another embodiment is a process of forming a photographic image by developing an exposed photographic element as described in the presence of a dinucleophile reagent. A further embodiment is a new photographically useful compound containing the new blocking group as described.

The blocked photographically useful compounds enable both improved storage stability and more rapid release upon processing of a photographic element containing such a compound. Both of these properties are achieved by the blocked photographically useful compounds as described due at least in part to the particular structure of the new blocking group. In the past it was possible for blocked photographically useful compounds to react with nucleophilic compounds containing one nucleophilic group, such as methylamine, hydroxide or water, that help reduce storage stability of the photographic element containing such compounds. The blocked photographically useful compounds of the invention do not release the photographically useful groups of the compound upon reaction with a nucleophilic compound containing only one nucleophilic group. Rather, release occurs only upon reaction with a nucleophilic compound containing two nucleophile groups, described herein as a dinucleophile reagent, such as hydroxylamines, hydrogen peroxide, hydrazine, diamines and substituted hydrazines. Carbonyl groups are preferred electrophilic groups in the new blocking groups as described.

The new blocking group structure resists reaction with nucleophilic compounds containing only one nucleophilic group. For example, reaction of a nucleophilic compound containing only one nucleophilic group at $E_1$ in the case of a carbonyl group would lead to adducts in which the hydroxyl group generated can internally react with $E_2$ only by a three or four member ring that is very difficult to form. In most cases, only compounds, such as water, that contain one nucleophilic group are encountered in storage of photographic silver halide elements. Such compounds would not release the blocking group of the invention as described.

In chemical systems requiring the good storage properties and the more rapid release properties of the compounds as described, the release of the blocking group can be initiated by reaction of the blocking group with an appropriate dinucleophile reagent. The selection of an appropriate dinucleophile reagent preferably enables formation of a five- or six-member ring compound. Depending upon the particular photographically useful group, the particular blocking group and the desired end use of the compound, the initiation of deblocking can take place by reacting the particular dinucleophile reagent at concentrations and under conditions that enable the desired rate of release.

The dinucleophile herein means a compound represented by the formula:

$$HNu_1—X^1—Nu_2H$$

wherein $Nu_1$ and $Nu_2$ individually are nucleophilic N, O, S, P, Se, substituted nitrogen atoms, or substituted carbon atoms; $X^1$ is a chain of j atoms wherein j is 0, 1 or 2. Illustrative examples of useful dinucleophile reagents are as follows:

| j = 0 | j = 1 | j = 2 |
|---|---|---|
| $H_2O_2$ | $NH_2CONH_2$ | $NH_2CH_2CH_2NH_2$ |
| $NH_2NH_2$ | 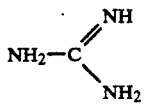 | $NH_2CH_2CO_2H$ |
| $CH_3NHNHCH_3$ | | $NH_2C(CH_3)_2CH_2OH$ |

-continued

| j = 0 | j = 1 | j = 2 |
|---|---|---|
| $NH_2OH$ | 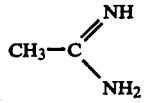 | $NH_2CH_2CH_2SH$ |
| $CH_3NHOH$ | | |
| $CH_3\overset{O}{\overset{\|\|}{C}}—NHOH$ | 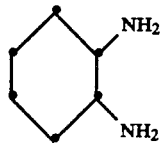 | |
| $CH_3SO_2NHNH_2$ | | |

Preferred dinucleophile reagents are hydroxylamine, hydrogen peroxide, and monosubstituted hydroxylamine. The dinucleophile reagent herein also includes a salt form of the reagent, such as the acid salts, for example, sulfate or bisulfite salts.

As used herein the term photographically useful group (PUG) refers to any group that can be used in a photographic material and that can be released from the blocking group as described. It refers to the part of the blocked photographically useful compound other than the blocking group. The PUG can be, for example, a photographic dye or photographic reagent. A photographic reagent herein is a moiety that upon release further reacts with components in the photograhic element. Such useful photographically useful groups include, for example, couplers (such as, image dye-forming couplers, development inhibitor releasing couplers, competing couplers, polymeric couplers and other forms of couplers), development inhibitors, bleach accelerators, bleach inhibitors, inhibitor releasing developers, dye precursors, developing agents (such as competing developing agents, dye-forming developing agents, developing agent precursors, and silver halide developing agents), silver ion fixing agents, silver halide solvents, silver halide complexing agents, image toners, pre-processing and post-processing image stabilizers, hardeners, tanning agents, fogging agents, antifoggants, ultraviolet radiation absorbers, nucleators, chemical and spectral sensitizers or desensitizers, surfactants, and precursors thereof and other addenda known to be useful in photographic materials.

The PUG can be present in the photographically useful compound as a preformed species or as a precursor. For example, a preformed development inhibitor may be bonded to the blocking group or the development inhibitor may be attached to a timing group that is released at a particular time and location in the photographic material. The PUG may be, for example, a preformed dye or a compound that forms a dye after release from the blocking group.

The photographically useful compound can optionally contain at least one releasable timing group (T) between PUG and the blocking group as described. The reaction of the photographically useful compound with a dinucleophile reagent can sequentially release the blocking group from the timing group and then the timing group can be released from the PUG. The term "timing group" herein also includes a linking group that involves little or no observable time in the release action. This can occur in, for example, the development step of an exposed photographic element when the developer composition comprises a dinucleophile reagent, such as a hydroxylamine. Any timing group that is known in the photographic art is useful as the timing group between PUG and the blocking group. Examples of useful timing groups are described in, for example, U.S. Pat. Nos. 4,248,962 and 4,409,323 and European Patent Application No. 255,085.

The particular timing groups employed, including the linkage by which they are attached to the PUG and the blocking group and the nature of the substituents on the timing group can be varied to help control such parameters as rate and time of bond cleavage of the blocking group and the PUG as well as diffusibility of the PUG and substituent groups.

If the PUG is joined to the blocking group only through the timing group, then the cleavage of the bond between the timing group and the blocking group releases the timing group and the PUG as a unit. The particular timing group in this case can control the rate and distance of diffusion in the photographic material before the PUG is released from the timing group. The timing group should not contain a structure that inhibits the reaction of the blocking group with a dinucleophile reagent.

In the formula as described timing groups $T_1$ and $T_2$ are independently selected to provide the desired rate and time of release of the PUG upon processing. The timing groups $T_1$ and $T_2$ can be the same or different. Examples of preferred timing groups for $T_1$ and $T_2$ are as follows:

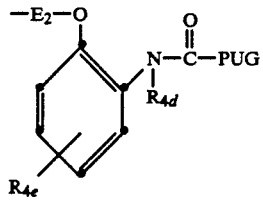

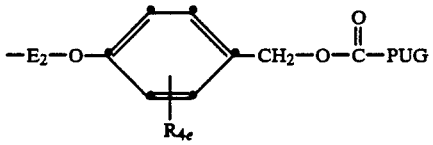

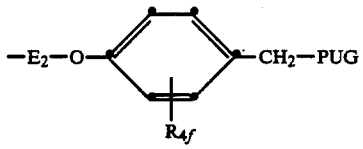

$-E_2-O-CH_2-PUG$ wherein $E_2$ and PUG are as described; and, $R_{4d}$, $R_{4e}$, and $R_{4f}$ are hydrogen or substituents, such as alkyl, aryl, nitro, chloro and sulfonamido.

Other examples of useful timing groups are described in, for example, U.S. Pat. Nos. 4,248,962 and 4,772,537.

In the blocking group as described the two electrophilic groups, $E_1$ and $E_2$, can be any electrophilic group that enables nucleophilic displacement reaction to occur upon reaction of the blocking group with dinucleophile reagent. While carbonyl groups are highly preferred as the electrophilic groups, other examples of useful electrophilic groups are as follows:

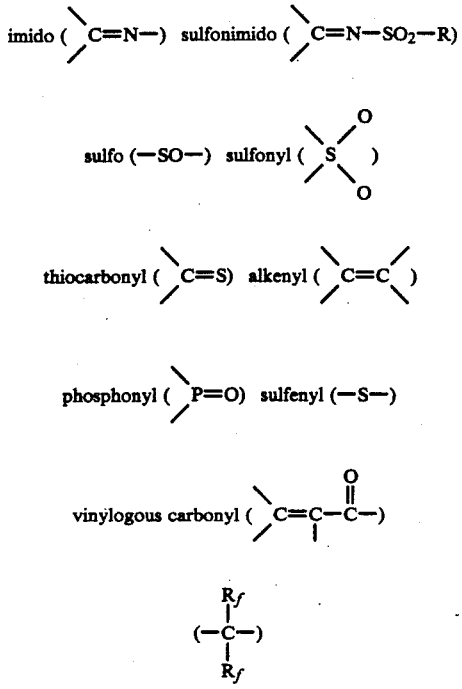

wherein $R_f$ is a substituent that causes the attached carbon atom to be an electrophilic center.

Highly preferred groups in the blocking group described containing Z, $Y^2$ and $R_3$ are as follows:

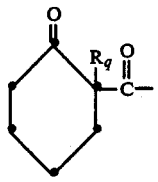

wherein $R_q$ is alkyl, such as methyl, ethyl, n-propyl, i-propyl, and butyl, or aryl, such as phenyl, benzyl or substituted phenyl or other substituents such as alkoxy, chloro and amido; and,

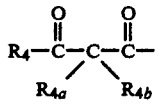

wherein $R_4$ is as described; $R_{4a}$ and $R_{4b}$ are individually as described, such as methyl, ethyl, n-propyl, i-propyl, butyl, phenyl, benzyl, and substituted phenyl, or other substituents such as alkoxy, chloro and amido.

Illustrative examples of useful PUG's that can be blocked with the blocking groups as described are as follows:

I. COUPLERS

A. Image Dye-Forming Couplers Illustrative couplers include cyan, magenta and yellow image dye-forming couplers that are known in the photographic art. Illustrative cyan dye-forming couplers that can comprise the blocking group, as described include, for example, those described in U.S. Pat. Nos. 2,772,162; 2,895,826; 3,002,836; 3,034,892; 2,474,293; 2,423,730;

2,367,531; 4,333,999; and 3,041,236. Illustrative magenta dye-forming couplers that can comprise the blocking group, as described include those described in, for example, U.S. Pat. Nos. 2,600,788; 2,369,489; 2,343,703; 2,311,082; 3,152,896; 3,152,896; 3,519,429; 3,062,653; and 2,908,573. Illustrative yellow dye-forming couplers that can contain the blocking group, as described include those described in, for example, U.S. Pat. Nos. 2,875,057; 2,407,210; 3,265,506; 2,298,443; 3,048,194; and 3,447,928.

B. Illustrative couplers that form colorless products upon reaction with oxidized color developing agents and contain the blocking group, as described include those described in, for example, U.S. Pat. Nos. 3,632,345; 3,928,041; 3,958,993; 3,961,959; and U.K. Patent No. 861,138.

C. Illustrative couplers that form black dyes upon reaction with oxidized color developing agents and that can contain the blocking group, as described, include those described in, for example, U.S. Pat. Nos. 1,939,231; 2,181,944; 2,333,106; and 4,126,461; German OLS Nos. 2,644,194 and 2,650,764.

D. Illustrative couplers that are development inhibitor releasing couplers (DIR couplers) and can contain the blocking group, as described, include those described in, for example, U.S. Pat. Nos. 4,248,962; 3,227,554; 3,384,657; 3,615,506; 3,617,291; 3,733,201; and U.K. No. 1,450,479. Preferred development inhibitors as PUG's are heterocyclic compounds, such as mercaptotetrazoles, mercaptotriazoles, mercaptooxadiazoles, selenotetrazoles, mercaptobenzothiazoles, selenobenzothiazoles, mercaptobenzoxazoles, selenobenzoxazoles, mercaptobenzimidazoles, selenobenzimidazoles, benzotriazoles, benzodiazoles and 1,2,4-triazoles, tetrazoles, and imidazoles.

E. PUG's that are, or form, dyes upon release: Useful dyes and dye precursors include azo, azomethine, azopyrazolone, indoaniline, indophenol, anthraquinone, triarylmethane, alizarin, nitro, quinoline, indigoid, oxanol, and phthalocyanine dyes and precursors of such dyes, such as leuco dyes, tetrazolium salts or shifted dyes. These dyes can be metal complexed or metal complexable. Representative patents describing such dyes are U.S. Pat. Nos. 3,880,568; 3,931,144; 3,932,380; 3,932,381; and 3,942,987. Structures of illustrative dyes that can be blocked as described are as follows:

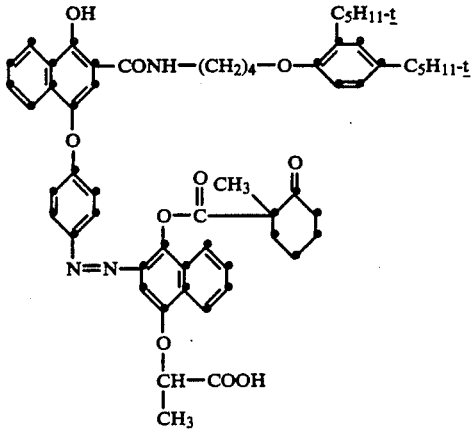

-continued

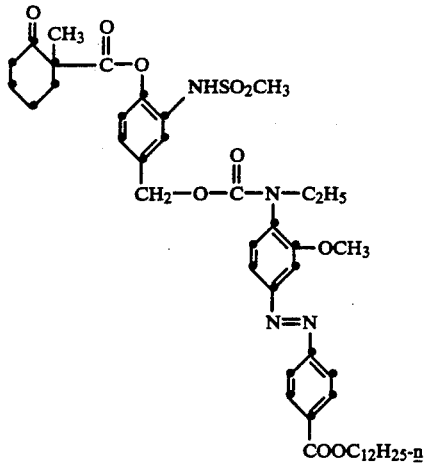

F. PUG's that form developing agents: Developing agents released can be color developing agents, black-and-white developing agents and cross-oxidizing developing agents. They include aminophenols, phenylenediamines, hydroquinones and pyrazolidones. Representative patents describing such developing agents are U.S. Pat. Nos. 2,193,015; 2,108,243; 2,592,364; 3,656,950; 3,658,525; 2,751,297; 2,289,367; 2,772,282; 2,743,279; 2,753,256; and 2,304,953.

Structures of preferred developing agents are:

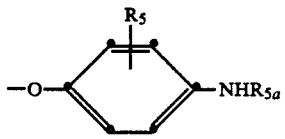

IIID-1 where $R_{5a}$ is hydrogen or alkyl of 1 to 4 carbon atoms and $R_5$ is hydrogen or one or more halogen (e.g. chloro, bromo) or alkyl of 1 to 4 carbon atoms (e.g. methyl, ethyl, butyl) groups and alkoxy.

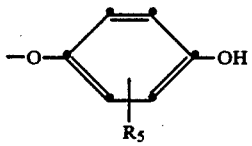

IIID-2 where $R_5$ is as defined above.

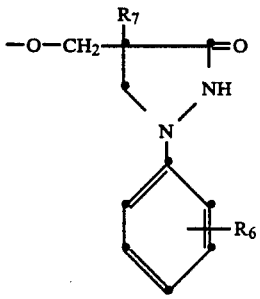

IIID-3

-continued

IIID-4

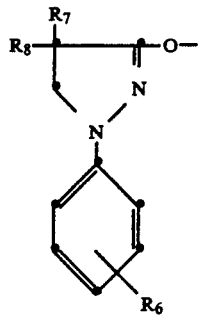

IIID-5

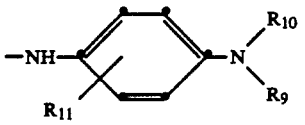

IIID-6

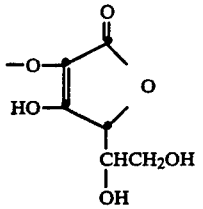

where $R_6$ is hydrogen or one or more alkyl, alkoxy or alkenedioxy groups of 1 to 4 carbon atoms and $R_7$, $R_8$, $R_9$, $R_{10}$ and $R_{11}$ are individually hydrogen, alkyl of 1 to 4 carbon atoms (e.g. methyl, ethyl) lower hydroxyalkyl of 1 to 4 carbon atoms (e.g. hydroxymethyl, hydroxyethyl) or lower sulfoalkyl.

G. PUG's that are bleach inhibitors: Representative bleach inhibitors that can be blocked as described include the illustrative bleach inhibitors described in, for example, U.S. Pat. Nos. 3,705,801; 3,715,208 and German OLS No. 2,405,279. Structures of illustrative bleach inhibitors are:

IIIE-1

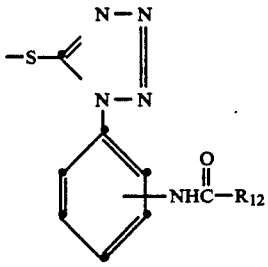

IIIE-2

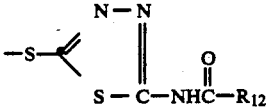

IIIE-3

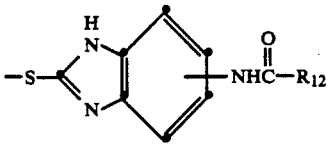

-continued

IIIE-4

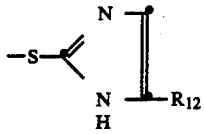

where $R_{12}$ is an alkyl group of 6 to 20 carbon atoms.

H. PUG's that are bleach accelerators: Representative bleach accelerators that can be blocked as described include the illustrative bleach accelerators represented by the following structures:

IIIF-1

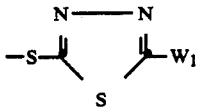

IIIF-2

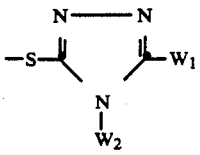

IIIF-3

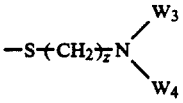

IIIF-4

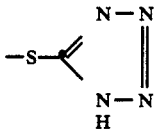

IIIF-5

$-SCH_2CH_2COOH$ wherein $W_1$ is hydrogen, alkyl, such as ethyl and butyl, alkoxy, such as ethoxy and butoxy, or alkylthio, such as ethylthio and butylthio, for example containing 1 to 6 carbon atoms, and which may be unsubstituted or substituted; $W_2$ is hydrogen, alkyl or aryl, such as phenyl; $W_3$ and $W_4$ are individually alkyl, such as alkyl containing 1 to 6 carbon atoms, for example ethyl and butyl or together can form a ring, such as morpholino; z is 1 to 6.

Other PUG's as described in the photographic art can also be blocked with a blocking group as described.

The blocked photographically useful compounds as described can be used in photographic materials and in ways that blocked photographic compounds have been used in the photographic art.

For example, the blocked photographic couplers can be incorporated in photographic elements and/or photographic processing compositions, such that upon development in the presence of a dinucleophile reagent the exposed photographic element and coupler will be in reactive association with oxidized color developing agent. When incorporated in a photographic element, the coupler compounds should as a rule be non-diffusible, that is they should be of such molecular size and configuration that they will not significantly diffuse or wander from the layer in which they are coated.

Photographic elements of the invention can be processed by conventional techniques in which color forming couplers and color developing agents are incorporated in separate processing solutions or compositions or in the photographic element. Optionally, blocked color developing agents can be incorporated in the photographic element and simplified processing solutions used for processing the element.

The photographic elements can be single color elements or multicolor elements. Multicolor elements contain dye image-forming units sensitive to each of the three primary regions of the visible spectrum. Each unit can be comprised of a single emulsion layer or of multiple emulsion layers sensitive to a given region of the spectrum. The layers of the element, including the layers of the image-forming units, can be arranged in various orders as known in the photographic art. In an alternative format, the emulsions sensitive to each of the three primary regions of the spectrum can be disposed as a single segmented layer, such as by the use of microvessels as described in U.S. Pat. No. 4,362,806.

A typical multicolor photographic element comprises a support bearing a cyan dye image-forming unit comprising at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one yellow dye-forming coupler. The element can contain added layers, such as filter layers, interlayers, overcoat layers, subbing layers, and the like.

The blocked photographically useful compounds as described can be present in and/or associated with one or more of the layers of the photographic element. The compounds can be in an emulsion layer and/or in an adjacent layer.

In the following discussion of materials useful in the emulsions and elements of the invention, reference will be made to Research Disclosure, December 1978, Item No. 17643, published by Industrial Opportunities Ltd., Homewell Havant, Hampshire, P09 1EF, U.K., the disclosures of which are incorporated herein by reference. The publication will be identified hereinafter by the term "Research Disclosure".

The silver halide emulsions employed in the elements can be comprised of silver bromide, silver chloride, silver iodide, silver chlorobromide, silver chloroiodide, silver bromoiodide, silver chlorobromoiodide or mixtures thereof. The emulsions can include coarse, medium or fine silver halide grains. High aspect ratio tabular grain emulsions are specifically contemplated, such as those described by Wilgus U.S. Pat. Nos. 4,434,226, Daubendiek et al 4,414,310, Wey 4,399,215, Solberg et al 4,433,048, Mignot 4,386,156, Evans et al 4,504,570, Maskasky 4,400,463, Wey et al 4,414,306, Maskasky 4,435,501 and 4,643,966 and Daubendiek et al 4,672,027 and 4,693,964. Also specifically contemplated are those silver bromoiodide grains with a higher molar proportion of iodide in the core of the grain than in the periphery of the grain, such as those described in GB No. 1,027,146; JA No. 54/48,521; U.S. Pat. Nos. 4,379,837; 4,444,877; 4,665,012; 4,686,178; 4,565,778; 4,728,602; 4,668,614; 4,636,461; EP No. 264,954. The silver halide emulsions can be either monodisperse or polydisperse as precipitated. The grain size distribution of the emulsions can be controlled by silver halide grain separation techniques or by blending silver halide emulsions of differing grain sizes.

Sensitizing compounds, such as compounds of copper, thallium, lead, bismuth, cadmium and Group VIII noble metals, can be present during precipitation of the silver halide emulsion.

The emulsions can be surface-sensitive emulsions, that is, emulsions that form latent images primarily on the surfaces of the silver halide grains, or internal latent image-forming emulsions, that is, emulsions that form latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

The silver halide emulsions can be surface sensitized. Noble metal (e.g., gold), middle chalcogen (e.g., sulfur, selenium, or tellurium), and reduction sensitizers, employed individually or in combination, are specifically contemplated. Typical chemical sensitizers are listed in *Research Disclosure*, Item 17643, cited above, Section III.

The silver halide emulsions can be spectrally sensitized with dyes from a variety of classes, including the polymethine dye class, which includes the cyanines, merocyanines, complex cyanines and merocyanines (i.e., tri-, tetra-, and poly-nuclear cyanines and merocyanines), oxonols, hemioxonols, styryls, merostryryls, and streptocyanines. Illustrative spectral sensitizing dyes are disclosed in *Research Disclosure*, Item 17643, cited above, Section IV.

Suitable vehicles for the emulsion layers and other layers of elements of this invention are described in Research Disclosure Item 17643, Section IX and the publications cited therein.

In addition to the couplers described herein the elements of this invention can include additional couplers as described in Research Disclosure Section VII, paragraphs D, E, F and G and the publications cited therein. These additional couplers can be incorporated as described in Research Disclosure Section VII, paragraph C and the publications cited therein.

The photographic elements of this invention can contain brighteners (Research Disclosure Section V), antifoggants and stabilizers (Research Disclosure Section VI), antistain agents and image dye stabilizers (Research Disclosure Section VII, paragraphs I and J), light absorbing and scattering materials (Research Disclosure Section VIII), hardeners (Research Disclosure Section X), coating aids (Research Disclosure Section XI), plasticizers and lubricants (Research Disclosure Section XII), antistatic agents (Research Disclosure Section XIII), matting agents (Research Disclosure Section XVI) and development modifiers (Research Disclosure Section XXI).

The photographic elements can be coated on a variety of supports as described in Research Disclosure Section XVII and the references described therein.

Photographic elements can be exposed to actinic radiation, typically in the visible region of the spectrum, to form a latent image as described in Research Disclosure Section XVIII and then processed to form a visible dye image as described in Research Disclosure Section XIX. Processing to form a visible dye image includes the step of contacting the element with a color developing agent to reduce developable silver halide and oxidize the color developing agent. Oxidized color developing agent in turn reacts with the coupler to yield a dye.

Preferred color developing agents are p-phenylene diamines. Especially preferred are 4-amino-3-methyl-N,N-diethylaniline hydrochloride, 4-amino-3-methyl-N-ethyl-N-β-(methanesulfonamido)ethylaniline sulfate hydrate, 4-amino-3-methyl-N-ethyl-N-β-hydroxyethylaniline sulfate, 4-amino-3-β-(methanesulfonamido)ethyl-N,N-diethylaniline hydrochloride and 4-amino-N-ethyl-N-(2-methoxyethyl)-m-toluidine di-p-toluene sulfonic acid.

With negative-working silver halide, the processing step described above provides a negative image. The described elements are preferably processed in the known C-41 color process as described in, for example, the British Journal of Photography Annual of 1988, pages 196–198. To provide a positive (or reversal) image, the color development step can be preceded by development with a non-chromogenic developing agent to develop exposed silver halide, but not form dye, and then uniformly fogging the element to render unexposed silver halide developable. Alternatively, a direct positive emulsion can be employed to obtain a positive image.

Development is followed by the conventional steps of bleaching, fixing, or bleach-fixing, to remove silver or silver halide, washing, and drying.

In processing it is necessary that the described dinucleophile reagent, such as a hydroxylamine, be present in the processing solution that is to be used to release or unblock the blocked photographically useful compound at the time desired. The concentration of the dinucleophile reagent in the processing solution can vary depending on such factors as the particular processing solution components, the particular dinucleophile reagent, the processing time and temperature, the particular photographic element to be processed, the desired image and the like. When the dinucleophile reagent is present in a color developer solution, the concentration of the dinucleophile reagent is typically within the range of $10^{-5}$ moles to 1 mole per liter of solution.

The blocked photographically useful compounds according to the invention can be prepared by methods and steps known in the organic compound synthesis art.

A typical method of preparing a blocked photographically useful compound is as follows:

SYNTHESIS I

A. Preparation of an intermediate 2,2-dimethyl-3-oxobutyryl chloride (G1)

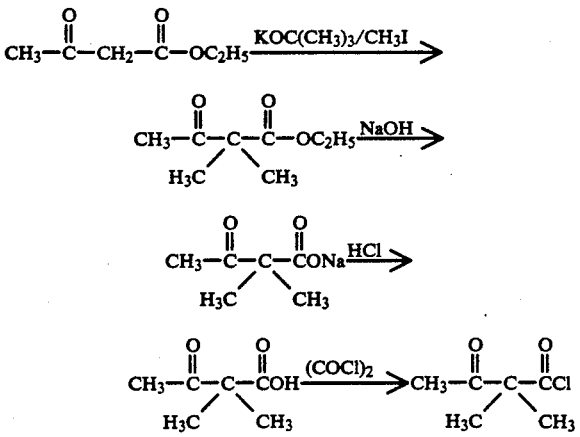

(G1)

This illustrative intermediate compound G1 can be reacted with a photographically useful group (PUG) to provide a blocked photographically useful compound as described.

A 2-liter, 3-necked round-bottomed flask containing ethyl acetoacetate (65 g, 0.5 mole), t-butanol (200 ml), and tetrahydrofuran (200 ml) was fitted with thermometer, mechanical stirrer, nitrogen inlet, and addition funnel topped with an ice water condenser. The mixture was cooled to 0° C. and stirred vigorously under a slow nitrogen stream while adding potassium t-butoxide (56 g, 0.5 mole) slowly (temp. <20° C.). A homogeneous solution resulted after about 5 minutes. Methyl iodide (32 ml, 0.5 mole) was added via the addition funnel while the temperature rose to about 10° C. The ice bath was replaced with a water bath at room temperature (20° C.) before stirring the mixture for an additional 30 minutes while potassium iodide precipitated. The mixture was cooled again to 0° C. before adding more methyl iodide (40 ml) and then potassium t-butoxide (56 g, 0.5 mole) (temp. <30° C.). The mixture was stirred at room temperature for 48 hours and then diluted with about 1 liter of water and 0.5 liter of saturated NaCl solution before the mixture was extracted with ether. The ether solution was washed with 0.1N NaOH and then with 1N HCl, dried over magnesium sulfate, and concentrated to an oil. The crude dimethylated ethyl acetoacetate (64 g, 81% yield) had an nmr spectrum that was consistent with the expected compound.

The crude dimethylated ester (64 g, approx. 0.4 mole), NaOH (48 g, 1.2 mole), water (320 ml), and a trace of indicator dye (Metanil Yellow) were stirred for 18 hours until a homogeneous solution resulted. Residual alkali-insoluble material was removed by washing with a small amount of ether. The alkaline solution was then cooled in ice water and neutralized carefully with concentrated HCl (approx. 100 ml) until the indicator dye turned purple. Saturated NaCl was added to the cold solution before extracting several times with methylene chloride. The extracts were dried over sodium sulfate, filtered and concentrated at 30° C. to yield the crude acid as an oil (50 g) (the acid solidifies at ice temperatures). The nmr spectrum showed that a small amount of ethanol was present in the crude acid. In order to avoid excessive decarboxylation, the acid was used immediately by reacting with oxalyl chloride (75 ml, 0.86 mole) and a trace of triethylamine at room temperature for 24 hours. The mixture was concentrated at 30° C. using a rotary evaporator with water aspirator vacuum. Excess oxalyl chloride was removed by codistillation with methylene chloride to yield crude 2,2-dimethyl-3-oxobutyryl chloride (49 g, 82%). A portion of the crude (45 g) was distilled through a six inch Vigreaux column under water aspirator vacuum (bp 50°–55° C.) to yield purified colorless product (30 g, 67%). A small amount of impurity containing an ethoxy group distilled with the later fractions of product. This impurity could be avoided by complete removal of ethanol prior to acid chloride formation.

Other illustrative intermediate compounds can be prepared in a similar manner. Illustrative compounds include G2 and G3 and are represented by the formulas:

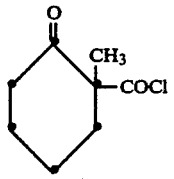
(G2)
-continued
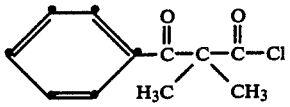
(G3)
The following is a specific illustrative synthesis of a blocked filter dye involving reaction with compound G2:
SYNTHESIS EXAMPLE A
Preparation of Compound (I)
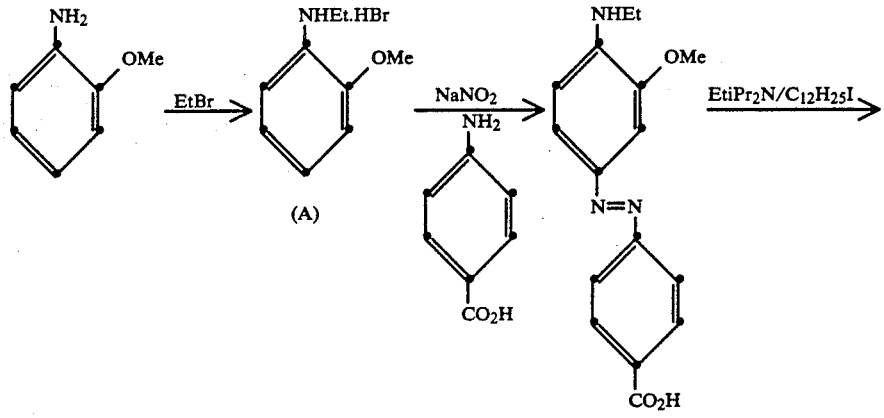
(A)
(B)
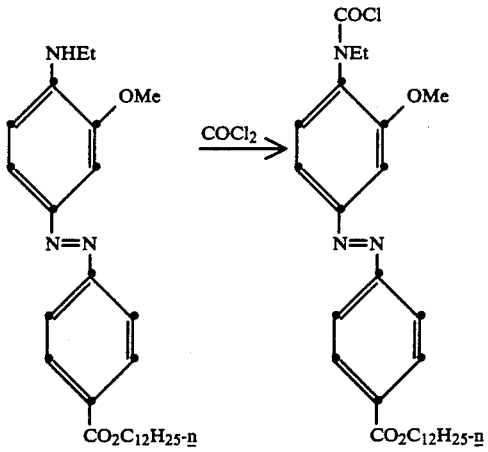
(C)
(D)
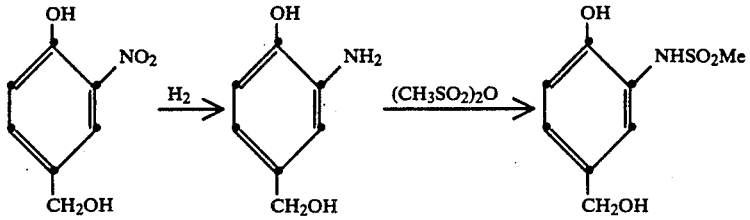
(E)
(F)

-continued

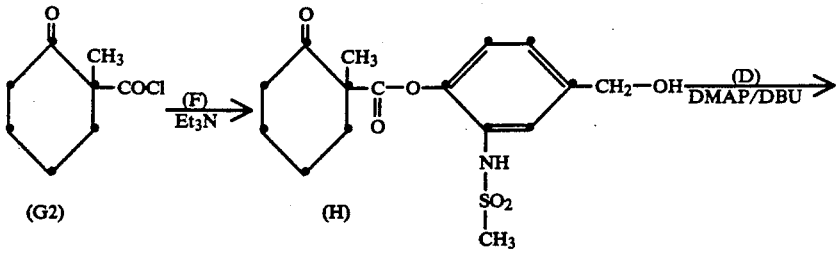

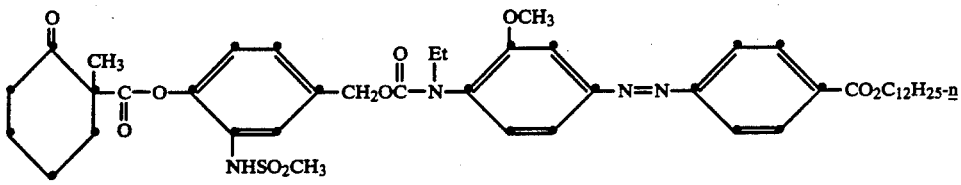

(I)

DMAP herein is 4-dimethylaminopyridine. DBU herein is 1,8-diazabicyclo[5.4.0]undec-7-ene. Ether means ethyl ether. $EtiPr_2N$ herein means ethyldiisopropylamine. Me herein means $CH_3$—. Et herein means $C_2H_5$. Temperatures herein are ° C. unless otherwise indicated.

Preparation of (A)

Ethyl bromide (500 g, 4.6 mole), o-anisidine (370 g, 3.0 mole), and isopropanol (1 l) were refluxed for 16 hours. The hot solution was poured into a container and cooled with ice. The crystalline hydrobromide salt was filtered, washed with cold isopropanol and ether. Recrystallization from a minimum volume of hot isopropanol with cooling at 0° overnight yielded 402 g (58%) of (A).

Preparation of (B)

Water (400 ml), conc. HCl (80 ml), and p-aminobenzoic acid (31.4 g, 0.21 mole) were mixed. After cooling the mixture to 0°, ice (100 g) and sodium nitrite (14.3 g, 0.21 mole) were added. After a few minutes when all of the nitrite had dissolved, a solution of (A) (48.0 g, 0.21 mole) in aqueous HCl (40 ml of conc. HCl, 200 ml of $H_2O$) was slowly added while maintaining the temperature near 0°. Sodium acetate (140 g) was slowly added to promote coupling. After stirring about 30 minutes, the mixture was filtered to obtain a mixture of dye and triazene. The triazene was rearranged to dye by stirring the crude product with acetic acid (about 200 ml) for 2 days at room temperature (20°) (or by heating for about 2 hours at 50°). The dye which precipitated from the acetic acid was filtered off and washed with methanol to yield 41.7 g (67%) of (B).

Preparation of (C)

The acidic dye (B) (41.7 g, 0.14 mole) was esterified by heating with dodecyliodide (45.6 g, 0.15 mole), ethyldiisopropylamine (19.4 g, 0.15 mole), and DMF (200 ml) at 100° for 3 hours. The crude mixture was diluted with ether, washed with 0.05N HCl and water, dried over $MgSO_4$, concentrated to an oil, and crystallized from methanol to yield 44.5 g (68%) of ballasted dye (C).

Preparation of (D)

Ballasted dye (D) (12.3 g, 0.0264 mole) and 2,6-lutidine (3.2 g, 0.03 mole) were dissolved in dichloromethane (200 ml) cooled to about 15°. Phosgene (30 ml of 1M solution in toluene, 0.03 mole) was added slowly before stirring the mixture for 20 minutes. The mixture was washed with cold aqueous 0.05N HCl and ice water before drying over $MgSO_4$. Crude carbamyl chloride (D) was obtained by concentration in vacuo. This was used directly in the reaction to form (I) without further purification.

Preparation of (E)

Commercially available 3-nitro-4-hydroxybenzyl alcohol (16.9 g, 0.1 mole) was hydrogenated at (40 psi) (3 atm) 280 Kilo Pascals in dioxane (300 ml) using 1 g of 5% Pd on carbon as catalyst. After the catalyst was filtered off, the solution was concentrated to form (E) as a crystalline solid (10 g, 72%).

Preparation of (F)

Aminophenol (E) (2.78 g, 0.02 mole) and 2,6-lutidine (2.36 g, 0.022 mole) were mixed with p-dioxane (40 ml). Methanesulfonic anhydride (3.48 g, 0.02 mole) was then added. After ½ hour, the mixture was diluted with ethyl acetate and washed twice with salt water (100 ml of saturated NaCl plus 15 ml of 1N HCl). After drying over $MgSO_4$, the ethyl acetate extract was concentrated to a solid residue. Crystallization from ethyl acetate:heptane yielded 3.2 g (75%) of product (F).

Preparation of (H)

A homogeneous solution of triethylamine (11.2 ml, 0.08 mole) and phenolic compound (F) (10.9 g, 0.05 mole) in tetrahydrofuran (100 ml) was cooled to −20° under a nitrogen atmosphere. A solution of acid chloride (G2) (8.75 g, 0.05 mole) in methylene chloride (50 ml) was then added. The mixture was warmed to room temperature for a few minutes, diluted with more solvent, and washed with 0.1N HCl. The organic layer was dried with magnesium sulfate and concentrated to an oil (19 g) which contained a small amount of solvent but was pure enough for use in the next step.

Preparation of (I)

Dye carbamyl chloride (D) (8.0 g, 0.015 mole), hydroxy compound (H) (5.3 g, 0.015 mole), DMAP (3.7 g, 0.03 mole), and DBU (6.8 g, 0.045 mole) were stirred in methylene chloride (30 ml) solution at room temperature for 30 minutes. The reaction was quenched by washing with aqueous 0.5N HCl, and the organic layer was dried over magnesium sulfate, and concentrated to a crude oil. The crude product was chromatographed on 750 g of silica gel using ethyl acetate:heptane (1:3) as eluent. Purified shifted filter dye (I) (7 g, 55%) was obtained as a glassy solid.

Another illustrative synthesis of a blocked photographically useful compound is as follows:

SYNTHESIS II

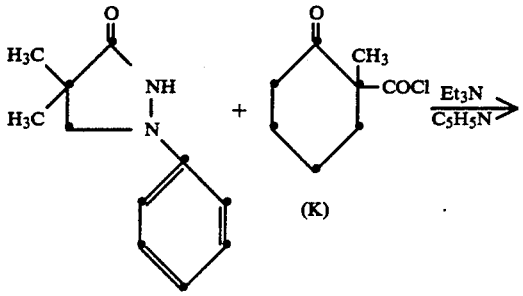

(K)

(J)

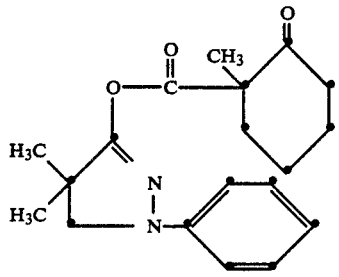

(L)

With stirring, 27.5 g. of compound J was dissolved in a solution of 50 ml of triethylamine and 450 ml of pyridine. Compound K (25.0 g) was added dropwise over a period of five minutes. The resulting mixture was stirred overnight at room temperature, concentrated under vacuum, and the residue stirred with 500 ml of ethyl ether. The mixture was filtered. The filtrate was washed five times with 500 ml portions of water and then with saturated aqueous sodium chloride solution. The resulting organic layer was dried over anhydrous magnesium sulfate. The solution was filtered and concentrated to provide 30 grams of light gold oil. Upon standing the light gold oil solidified. The solid was broken up by stirring with petroleum ether (bp 30°-60°) and then collected by filtration to provide 22.5 g of white solid melting at 74°-75° C. The desired compound was identified by NMR.

H NMR ($CDCl_3$) 7.2-7.3 (triplet, 2H); 6.9-7.0 (doublet, 2H); 6.8-6.9 (triplet, 1H); 3.6 (singlet, 2H); 2.5-2.6 (multiplet, 3H); 2.0-2.1 (multiplet, 1H); 1.5-1.9 (multiplet, 4H); 1.4-1.5 (singlet, 3H); and 1.2-1.3 ppm (singlet, 6H).

$^{13}C$ NMR ($CDCl_3$) 206.6, 170.0, 158.5, 146.5, 128,6, 119.2, 112.8, 63,8, 57.1, 44.4, 39.9, 37.4, 27.0, 23.3, 21.8, and 20.7 ppm.

In chemical systems that require a blocked reagent, the reagent can be released by reaction with a dinucleophile reagent. The reagent can be released by any dinucleophile reagent that is compatible with the particular chemical system. Selection of an optimum dinucleophile reagent and a particular blocked reagent will depend upon the particular chemical system, the desired end use of the blocked reagent, the particular conditions used for release. The blocking group can be as described in such blocked reagents.

The following examples further illustrate the invention.:

EXAMPLE 1

Model studies were conducted on esters E-1 through E-5 to determine the possible rate enhancement which could be attained by using a dinucleophile rather than a mononucleophile to promote the removal from a phenolic moiety of a blocking group of this invention. Aqueous solutions A, B, and C, each containing 50% by volume of acetonitrile were prepared as follows (a separate solution A for each ester):

| | |
|---|---|
| Solution A: | $2.5 \times 10^{-4}$ M ester (or $2.5 \times 10^{-5}$ M E-1); 0.2 N KCl |
| Solution B: | 25% by volume carbonate buffer (ionic strength 0.75); 0.05 N KCl |
| Solution C: | Solution B with added 0.05 M hydroxylamine |

Then equal volumes of A and B (or A and C) were mixed at 25° C. to give a pH 10.0 solution and the reaction was followed by spectrophotometric measurements of the phenol (272 nm) or p-nitrophenol (402 nm) produced with time. In each case a reaction half-life ($t_{\frac{1}{2}}$) was calculated from the equation $t_{\frac{1}{2}} = \ln(2)/k$, where ln(2) is the natural logarithm of 2 and k is the pseudo first-order rate constant calculated for the reaction. Smaller half-lives thus indicate more rapid reactions. The A+B combination provides an alkaline solution in which the main reactant is hydroxide ion (a mononucleophile) while in the A+C combination the active reactant is hydroxylamine (a dinucleophile). A ratio of the A+B half-life to the A+C half-life provides a measure of rate enhancement due to participation of hydroxylamine in the deblocking reaction. The results are shown in Table I:

TABLE I

| | $t_{\frac{1}{2}}$A + B | $t_{\frac{1}{2}}$A + C | Ratio |
|---|---|---|---|
| 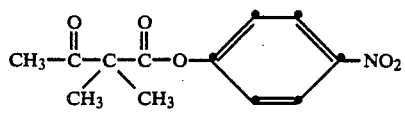 E-1 (Invention) | $62 \times 10^3$ | 1.7 | $36 \times 10^3$ |

TABLE I-continued

| | $t_{\frac{1}{2}}A + B$ | $t_{\frac{1}{2}}A + C$ | Ratio |
|---|---|---|---|
| 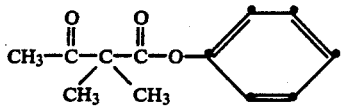 E-2 (Invention) | $800 \times 10^3$ | 8.6 | $93 \times 10^3$ |
| 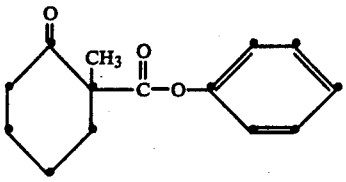 E-3 (Invention) | $20 \times 10^6$ | 6.3 | $3.2 \times 10^6$ |
| 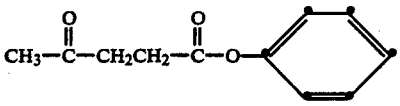 E-4 (Comparison) | $9.3 \times 10^3$ | 200 | 47 |
| 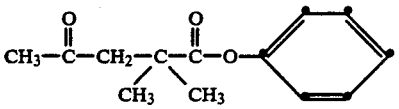 E-5 (Comparison) | $130 \times 10^3$ | 785 | 166 |

It can be seen from Table I that the rate enhancement due to dinucleophile (hydroxylamine) participation in the hydrolysis of esters E-1, E-2, and E-3 using blocking groups of the invention are twenty to seventy thousand times greater than for the comparison blocking groups in esters E-4 and E-5. The esters representing blocking groups of the invention give the rapid deblocking of a few seconds needed for pH 10 processing while maintaining excellent resistance toward base hydrolysis. These results would predict that a blocked PUG according to the invention would be quite stable under pre-processing storage conditions since only mononucleophiles are present in storage yet capable of rapid PUG release at a desired time during processing.

EXAMPLE 2

This example demonstrates that a blocked electron transfer agent (ETA) when incorporated in a photographic light sensitive element can be deblocked rapidly when the processing solution contains the dinucleophile hydroxylamine sulfate (HAS). A green sensitized silver bromoiodide gelatin emulsion (0.7 micron grain size) was mixed with a coupler dispersion comprising cyan coupler C-1 dispersed in half its weight of di-n-butyl phthalate and a blocked ETA compound of the invention dispersed in twice its weight of N,N-diethyl lauramide. The resulting mixture was coated on a photographic film support according to the following format (amounts of each component are given in mg/m$^2$ with silver halide counted as silver):

| | |
|---|---|
| OVERCOAT LAYER: | Gelatin (5382); bis(vinylsulfonylmethyl) ether hardener (2% of total gelatin weight) |
| EMULSION LAYER: | Gelatin (3229); green-sensitized AgBrI emulsion (877); cyan coupler C-1 (969); and a blocked ETA compound (levels indicated in Table II) |
| FILM SUPPORT: | |

-continued

Cyan Coupler C-1:

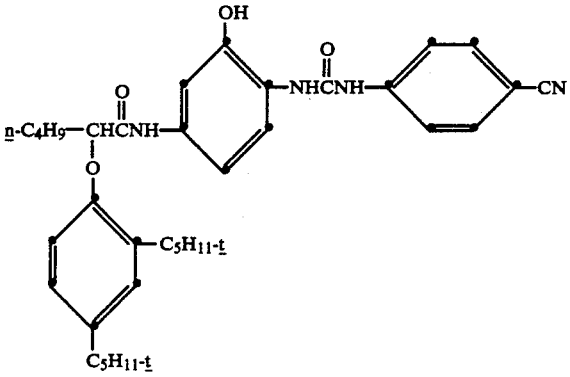

Blocked ETA Compound 1:

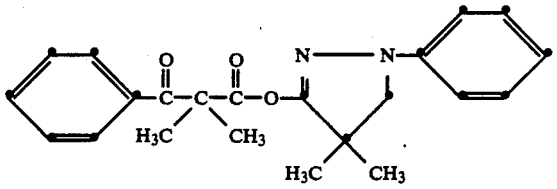

Blocked ETA Compound 2:

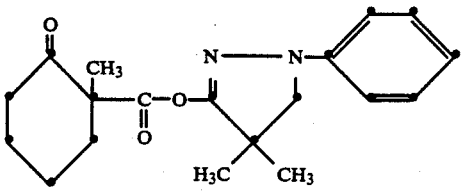

Each photographic element was imagewise exposed to light through a graduated density test object in a commercial sensitometer to provide a developable latent image (3000° K. light source, 0–4 step wedge, with Wratten 99 plus 0.5ND filter. Wratten is a trademark). The resulting photographic film was then developed and processed in a commercial C-41 development process of Eastman Kodak Company, U.S.A. without the final stabilizer step. This process and the processing compositions for the process are described in, for example, British Journal of Photography Annual 1988, Pages 191–199. The development process was carried out with and without hydroxylamine sulfate (HAS) in the color developer solution.

Densitometric measurements made with red light are shown in Table II wherein the values in parentheses are for the samples processed in the developer without HAS. Dmin is the average fog level. Gamma is the maximum contrast between two density points which are 0.4 log E apart, taken as the difference from the gamma of the control sample which contains no blocked ETA compound. Photographic speed is also taken relative to the control sample (set at 100) and is measured at 0.15 density above fog.

TABLE II

| Blocked ETA | Amt. Added (mmole/m²) | Dmin | | Relative Gamma Difference | | Relative Speed | |
|---|---|---|---|---|---|---|---|
| None | — | 0.08 | (0.07) | 0 | (0) | 100 | (100) |
| Compd. 1 | 0.215 | 0.07 | (0.06) | −0.01 | (−0.06) | 102 | (100) |
| " | 0.431 | 0.07 | (0.06) | −0.08 | (−0.09) | 103 | (101) |
| " | 1.076 | 0.07 | (0.05) | −0.54 | (−0.35) | 105 | (100) |
| Compd. 2 | 0.215 | 0.09 | (0.06) | +0.10 | (−0.02) | 108 | (100) |
| " | 0.431 | 0.09 | (0.06) | −0.04 | (−0.01) | 109 | (100) |
| " | 1.076 | 0.09 | (0.06) | −0.53 | (−0.18) | 109 | (101) |

The data in Table II show that the compounds of the invention deblock rapidly in the presence of hydroxylamine sulfate to release an ETA compound which can produce a significant speed increase even at low addenda levels.

EXAMPLE 3

To demonstrate the use of a shifted masking coupler, photographic elements were prepared using Compound 3 of the invention and comparison Compound 3U of the corresponding unblocked structures:

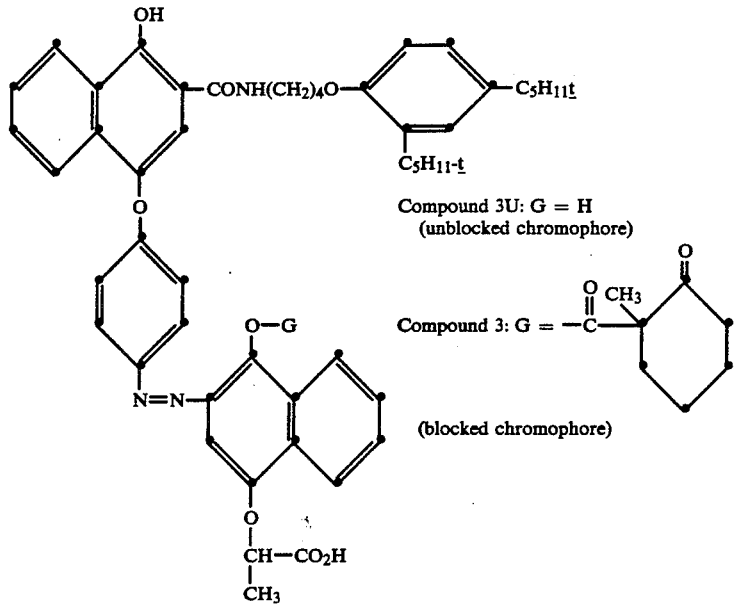

Each compound was dispersed in an equal weight of 2,4-di-t-pentylphenol and coated in the following format on a poly(ethylene terephthalate) film support (unless otherwise specified, component amounts are given in mg/m² with silver halide counted as silver):

| | |
|---|---|
| OVERCOAT LAYER: | Gelatin (2691); bis(vinylsulfonylmethyl) ether hardener (1.75% of total gelatin weight) |
| EMULSION LAYER: | Gelatin (3767); unsensitized AgBr emulsion (906); masking coupler indicated in Table III (1.08 mmole/m²) |
| FILM SUPPORT: | |

Unexposed strips of this coated element were soaked 1 minute in a fixing solution to remove silver halide, washed, and then immersed in one of the following processing solutions at temperatures conventionally used for processing in a KODAK C-41 process:

P-1: pH 10 carbonate buffer
P-2: pH 10 carbonate buffer with 0.024M hydroxylamine sulfate
P-3: C-41 color developer with hydroxylamine sulfate omitted
P-4: C-41 color developer solution containing hydroxylamine sulfate The results are presented in Table III:

TABLE III

| Treatment | Density at 520 nm Compd. 3U | Compd. 3 |
|---|---|---|
| Fixed Only | 1.25 | 0.02 |
| P-1: 10 Minutes | 1.25 | 0.02 |
| P-2: 10 Minutes | 1.25 | 1.10 |
| P-3: 10 Minutes | 1.25 | 0.02 |
| P-4: 1 Minute | 1.25 | 0.50 |
| P-4: 10 Minutes | 1.25 | 1.25 |

The data in Table III demonstrate that the blocked masking coupler Compound 3 of the invention is not unblocked by extended treatment with an alkaline bath (P-1) containing carbonate and hydroxide ions or a developer solution (P-3) which does not contain a dinucleophile. However, when the dinucleophile hydroxylamine is added to either of these solutions, as in P-2 and P-4, the blocking group is readily removed from the blocked masking coupler Compound 3 to form the corresponding unblocked Compound 3U. The absorption maximum of blocked Compound 3 is shifted to about 375 nm so that it absorbs very little green light until it is unblocked by a dinucleophile during processing.

EXAMPLE 4

Strips of the same coated photographic elements described above in Example 3 were either fixed to remove silver halide or were given a stepped exposure to white light and then C-41 processing as in Example 2. Densities to red, green, and blue light for low and high exposure steps were measured as shown in Table IV:

TABLE IV

| | Exposure | | | | | |
|---|---|---|---|---|---|---|
| | Blue Density | | Green Density | | Red Density | |
| Compd. | 3U | 3 | 3U | 3 | 3U | 3 |
| None (Fixed) | 0.64 | 0.85 | 1.18 | 0.08 | 0.09 | 0.04 |
| Low | 0.65 | 0.71 | 1.22 | 0.90 | 0.13 | 0.11 |
| High | 0.24 | 0.16 | 0.36 | 0.24 | 1.82 | 2.08 |

The Table IV data for coatings containing high levels of masking coupler (and none of the normally present image coupler) demonstrate that a positive masking image to blue and green light is produced in addition to the negative image to red light. The no-exposure sample containing blocked masking coupler Compound 3, however, shows the added advantage of extremely low density to green light compared to the counterpart Compound 3U in which the same chromophore is unblocked. Before processing the blocked masking coupler allows more green light to pass to lower photographic layers and yet after processing it can provide the desired compensation for unwanted spectral absorptions of the image dye.

EXAMPLE 5

This example demonstrates the use of a blocked masking coupler in the presence of a main image coupler in a monochrome layer. Dispersions were made as in Example 3 but with added cyan coupler C-1 dispersed in half its weight of di-n-butyl phthalate. These were then coated in the following format (unless otherwise specified, component amounts are given in mg/m$^2$ with silver halide counted as silver):

| | |
|---|---|
| OVERCOAT LAYER: | Gelatin (2691); bis(vinylsulfonylmethyl) ether hardener (1.75% of total gelatin weight) |
| EMULSION LAYER: | Gelatin (3767); unsensitized AgBrI emulsion (1615); cyan image coupler C-1 (754): masking coupler indicated in Table V (0.108 mmole/m$^2$) |
| FILM SUPPORT: | with antihalation backing |

Film strips of the above coatings were step-exposed through a Wratten 12 (minus blue) filter, processed (C-41) as in Example 2, and the photographic parameters measured as presented in Table V (density to green light was measured for unexposed fixed strips and for low and high exposure areas of processed strips; photographic speed of the red image is relative to the control at 100):

TABLE V

| | Added Masking Coupler | Green Density @ Exp. None | Low | High | Red Image Dmax | Gamma | Spd. |
|---|---|---|---|---|---|---|---|
| Control | None | 0.06 | 0.06 | 0.38 | 2.44 | 2.33 | 100 |
| Comparison | Compd. 3U | 0.21 | 0.24 | 0.40 | 2.59 | 2.24 | 82 |
| Invention | Compd. 3 | 0.08 | 0.26 | 0.43 | 2.62 | 2.42 | 99 |

The Table V data show that both masking couplers are providing desired density to green light in low exposure areas but that Compound 3 containing the blocked chromophore of the invention has the advantage over comparison Compound 3U (unblocked) in that it absorbs very little green light until the film is processed. The use of such shifted masking couplers in a multilayer color film allows better light utilization during exposure and much less absorption in upper layers of light needed in lower layers to provide desired photographic speed.

EXAMPLE 6

To demonstrate the utility of a non-light sensitive photographic layer containing a blocked filter dye, three such compounds were each dispersed in half their weight of di-n-butyl phthalate and coated on a film support in the following format (component amounts are in mg/m$^2$):

| | |
|---|---|
| FILTER DYE LAYER: | Gelatin (4844); blocked filter dye indicated in Table VI (377); bis(vinylsulfonylmethyl) ether hardener (85) |
| FILM SUPPORT | |

Compound 4: $Q_1$ = $NHSO_2CH_3$
Compound 5: $Q_1$ = Cl

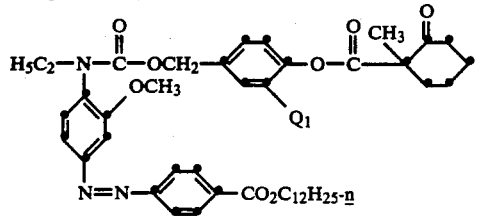

Compound 6:

-continued

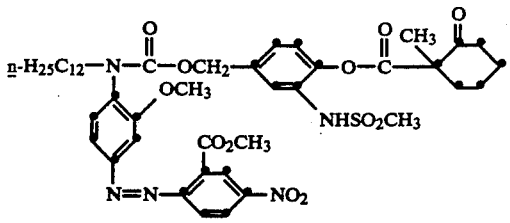

Strips of each coating were soaked at 38° C. in C-41 developer or in the same C-41 developer formulation from which hydroxylamine sulfate (HAS) had been omitted. The rate of deblocking of each filter dye was followed by measuring the density at the absorption maximum of the unblocked dye at selected time intervals. The results are presented in Table VI:

TABLE VI

| | | Filter Dyes: Density at λmax of Unblocked Dye | | | | | |
|---|---|---|---|---|---|---|---|
| | λmax (Un- | (Comparative Example) C-41 Dev. (No HAS) | | | (Invention) C-41 Developer | | |
| Cmpd. | blocked) | 0' | 1' | 10' | 0' | 1' | 10' |
| 4 | 440 nm | 0.05 | 0.09 | 0.10 | 0.05 | 1.08 | 1.10 |
| 5 | 440 nm | 0.03 | 0.03 | 0.05 | 0.03 | 0.08 | 0.71 |

TABLE VI-continued

| | | Filter Dyes: Density at λmax of Unblocked Dye | | | | | |
|---|---|---|---|---|---|---|---|
| | λmax (Un- | (Comparative Example) C-41 Dev. (No HAS) | | | (Invention) C-41 Developer | | |
| Cmpd. | blocked) | 0' | 1' | 10' | 0' | 1' | 10' |
| 6 | 495 nm | 0.03 | 0.05 | 0.06 | 0.05 | 0.84 | 0.89 |

It can be seen from the densities at the processing times shown in Table VI that the blocked filter dyes of this invention are released much too slowly in the absence of hydroxylamine to be useful in pH 10 photographic processes. The blocked filter dyes have the desirable stability for long-term keeping at the pH 5.5–6 in an unprocessed coating. In accelerated keeping tests at least 95% of the blocked filter dye was recovered unchanged. However, in the commercial C-41 developer, which contains the hydroxylamine dinucleophile, useful filter dye densities are achieved quite rapidly.

EXAMPLES 7–33

The following blocked photographically useful compounds can be prepared by the methods described. These blocked compounds can be incorporated and processed in a photographic element as described, such as in the element and process of Example 1: (The example number is given for each compound.)

Image Couplers:

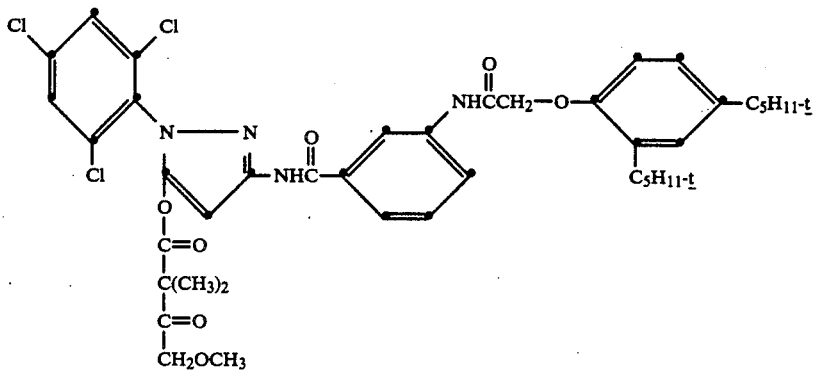

7.

-continued
8.
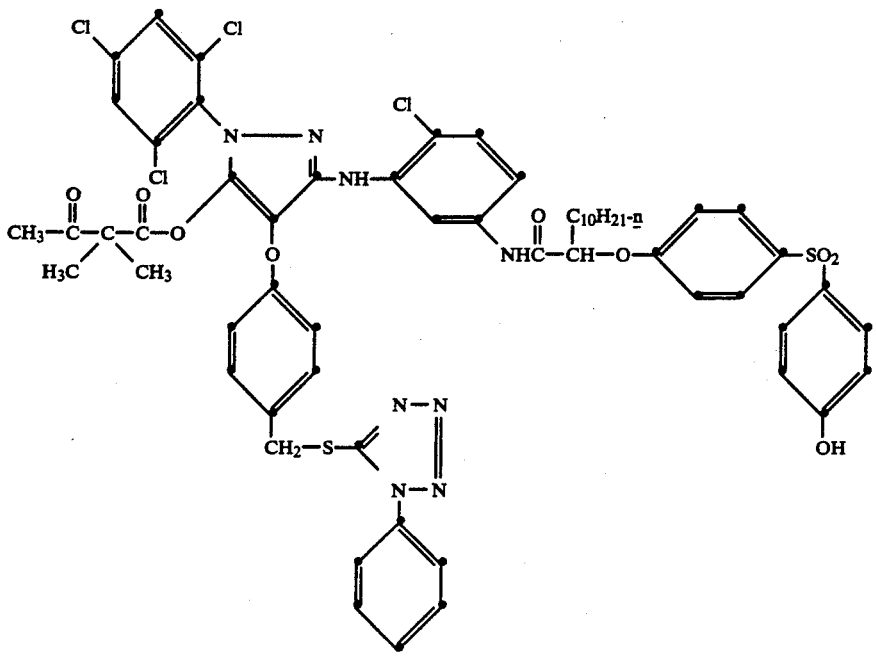
9.
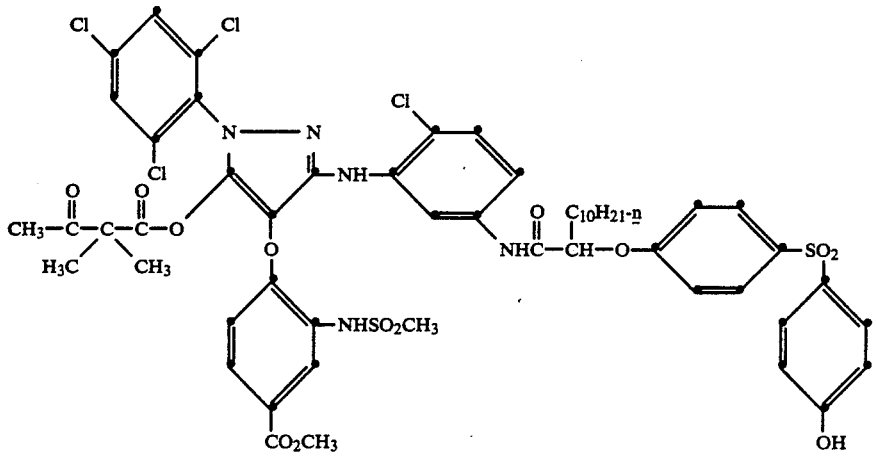
Masking Couplers:
10.
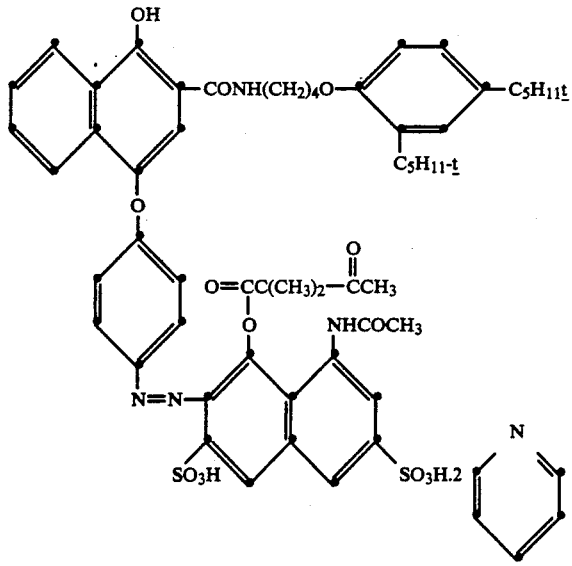

-continued
11.
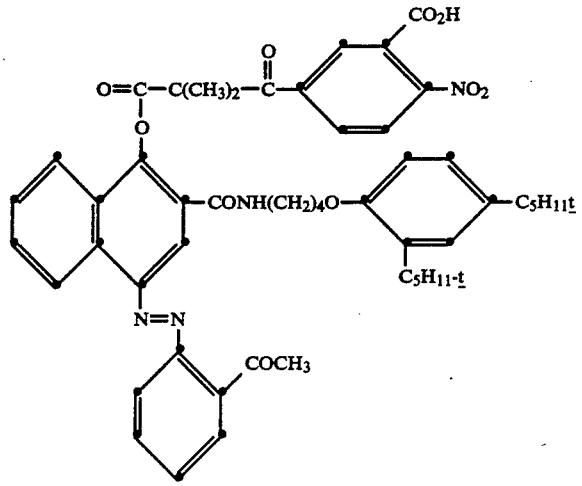
12.
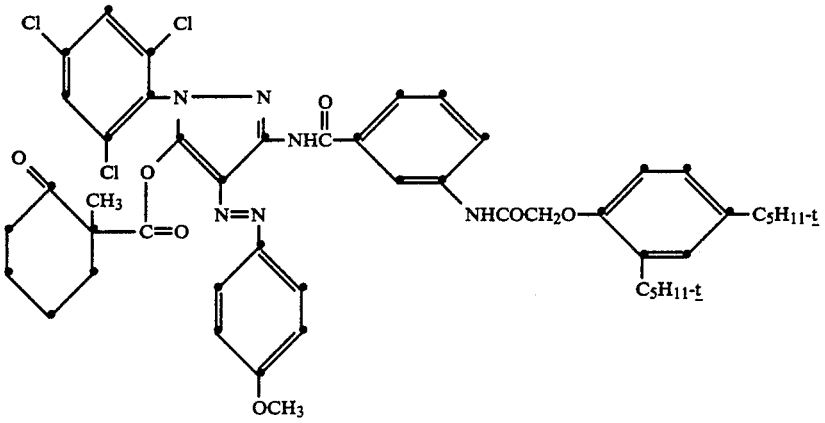
13.
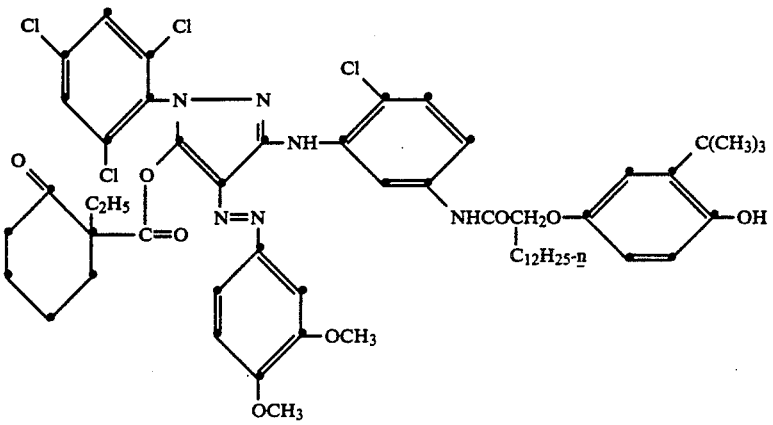

-continued
14.
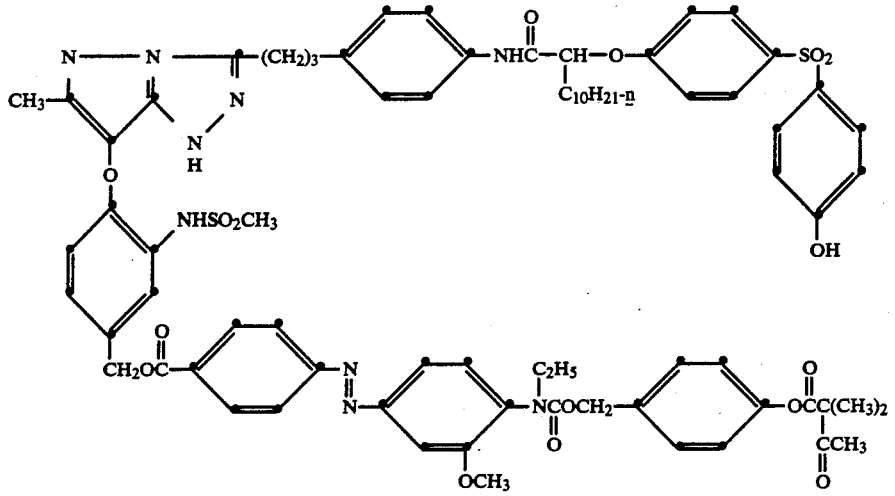
15.
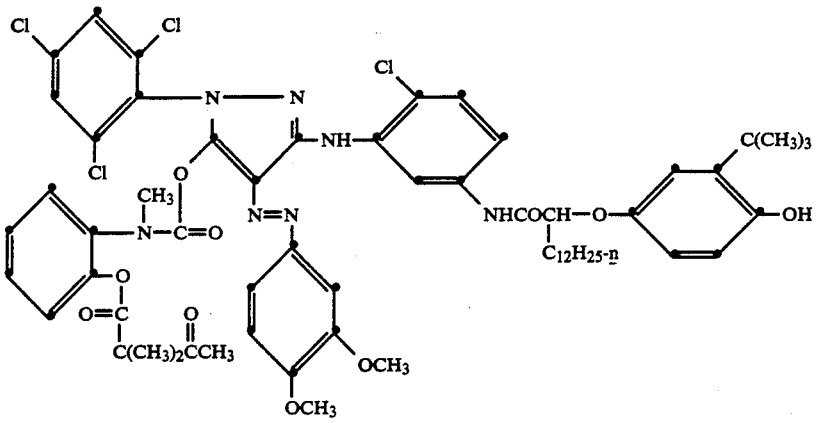
Development Accelerators and Electron Transfer Agents:
16.
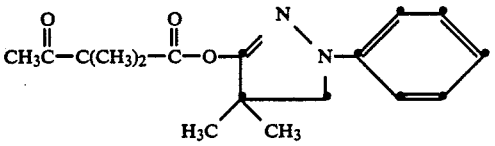
17.
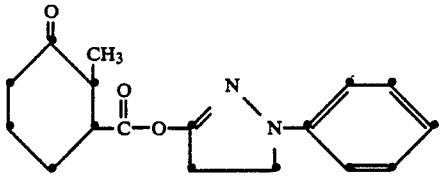
18.
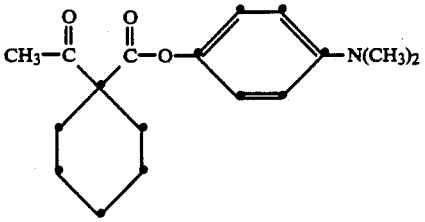
19.
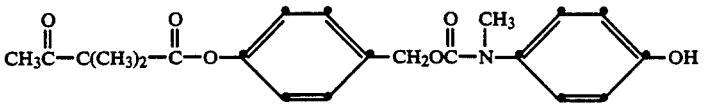

-continued
20.
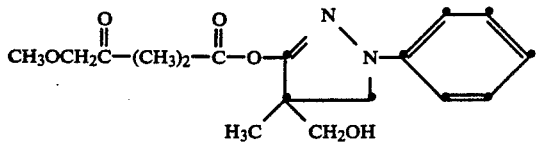
21.
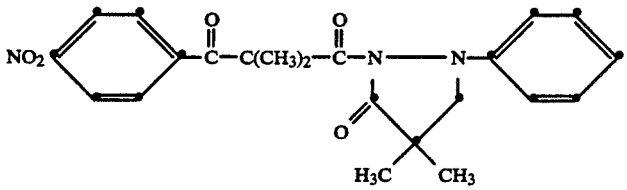
22.
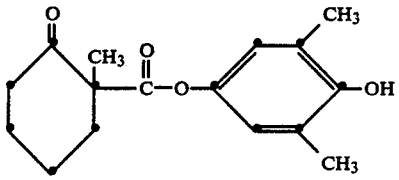
23.
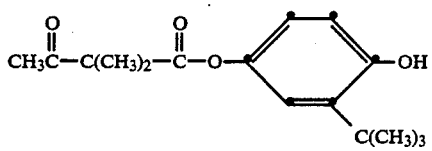
24.
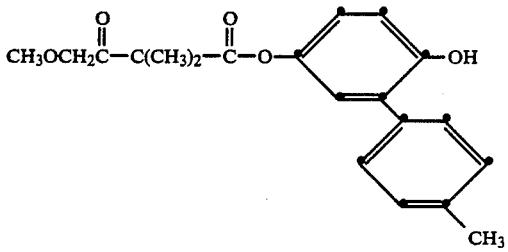
Dox Scavenger:
25.
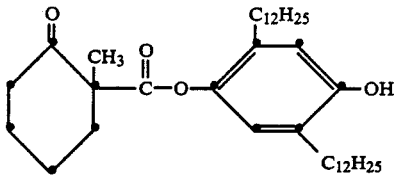
Color Developers:
26.
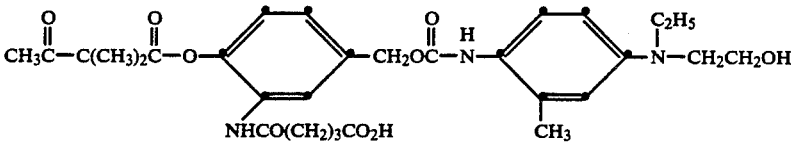
27.
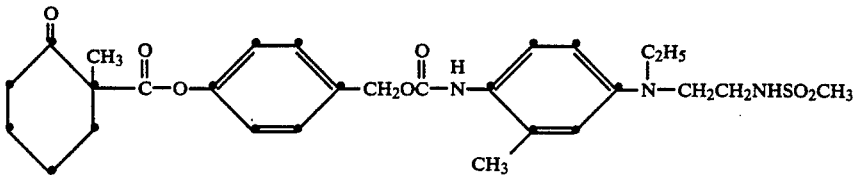
Antifoggants:

-continued
28.
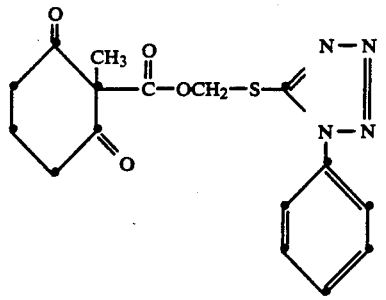
29.
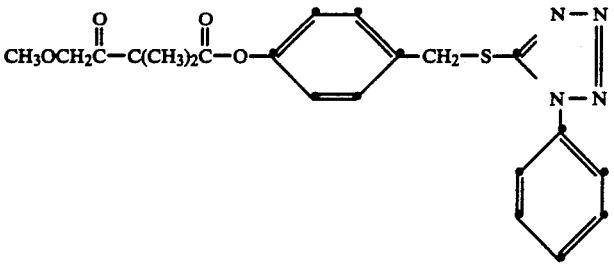
Other Compounds:
30.
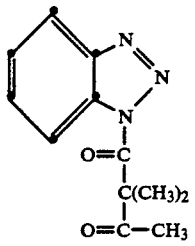
31.
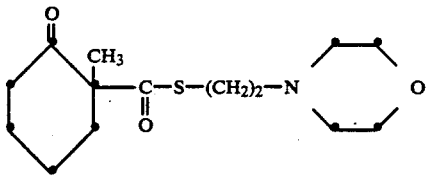
32.
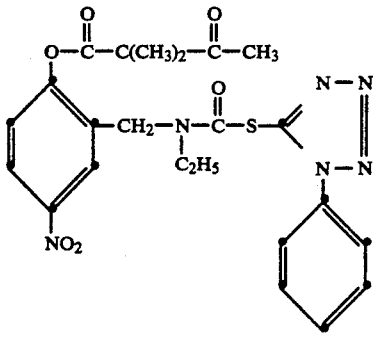

-continued

33.

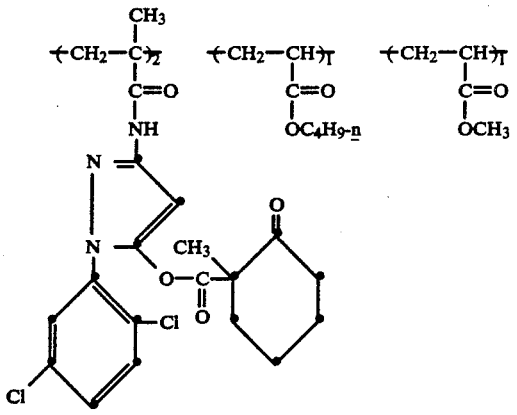

34.

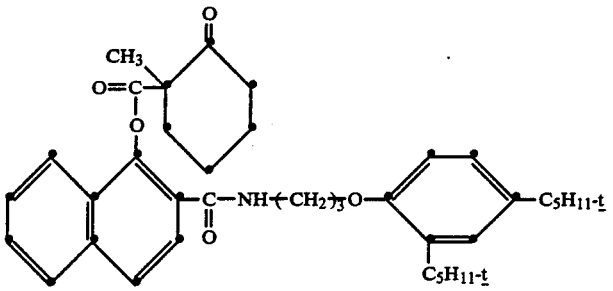

35.

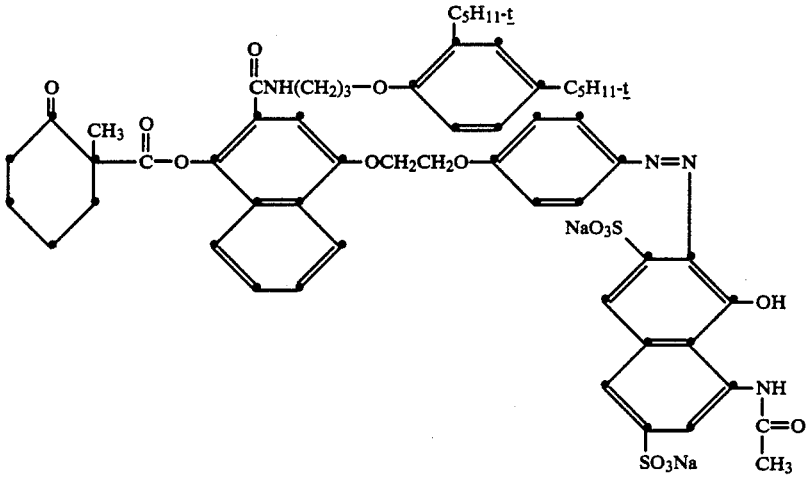

36.

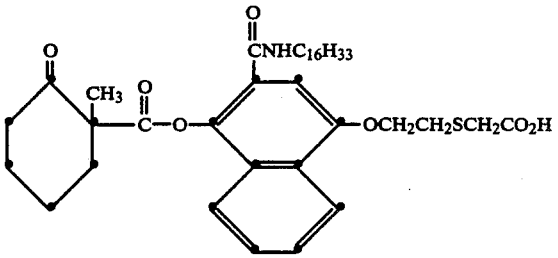

The invention has been described in detail with particular reference to particular embodiments thereof, but it will be understood that variations and modifications can be effected within the spirit and scope of the invention.

What is claimed is:

1. A photographic element comprising a support bearing at least one silver halide photographic emulsion layer and a blocked photographically useful compound comprising a photographically useful group and a blocking group that is capable of releasing the photographically useful group upon processing the photographic element wherein the blocking group (a) comprises two electrophilic groups, the least electrophilic of which is bonded directly or through a releasable timing group to the photographically useful group;

(b) is capable of reacting with a dinucleophile; and, (c) the two electrophilic groups are separated from each other by a substituted atom that enables a nucleophilic displacement reaction to occur with release of PUG upon processing the photographic element in the presence of a dinucleophilic reagent.

2. A photographic element as in claim 1 wherein the blocked photographically useful compound is represented by the formula:

$$[E_1 \leftarrow Y^1 \rightarrow E_2-(T_1)_x-(T_2)_y]_n-PUG$$

wherein $E_1$ and $E_2$ are independently electrophilic groups, wherein $E_1$ is more electrophilic than $E_2$;

$T_1$ and $T_2$ are individually releasable timing groups;

$Y^1$ is a substituted atom that provides a distance between $E_1$ and $E_2$ that enables a nucleophilic displacement reaction to occur with release of PUG upon processing the photographic element in the presence of a dinucleophile;

PUG is a photographically useful group capable of being released upon processing the photographic element;

x and y are independently 0 or 1; and, n is 1 or 2.

3. A photographic element as in claim 1 wherein the blocked photographically useful compound is represented by the formula:

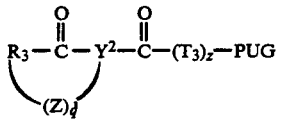

wherein $R_3$ is unsubstituted or substituted alkyl, unsubstituted or substituted aryl, or the atoms necessary with Z to complete a ring with $Y^2$;

Z represents the atoms necessary to complete a ring with $R_3$ and $Y^2$ $Y^2$ is a substituted carbon atom that provides a distance between the carbonyl groups that enables a nucleophilic displacement reaction to occur with release of PUG upon processing the photographic element in the presence of a dinucleophile;

q and z are independently 0 or 1;

$T_3$ is a releasable timing group; and,

PUG is a photographically useful group.

4. A photographic element as in claim 1 wherein the blocked photographically useful compound is represented by the formula:

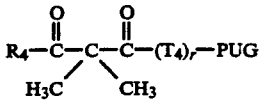

wherein $R_4$ is unsubstituted or substituted alkyl or unsubstituted or substituted aryl; PUG is a photographically useful group; $T_4$ is a releasable timing group; and, r is 0 or 1.

5. A photographic element as in claim 1 wherein the blocked photographically useful compound is represented by the formula:

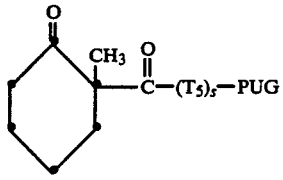

wherein PUG is a photographically useful group; $T_5$ is a releasable timing group; and s is 0 or 1.

6. A photographic element as in claim 1 wherein the PUG is a coupler, dye, nucleating agent, development accelerator, inhibitor releasing developer, color developer, development restrainer, antifoggant, bleach accelerator, bleach inhibitor, hardener, silver halide solvent, or precursors thereof.

7. A photographic element as in claim 1 wherein the blocked photographically useful compound is

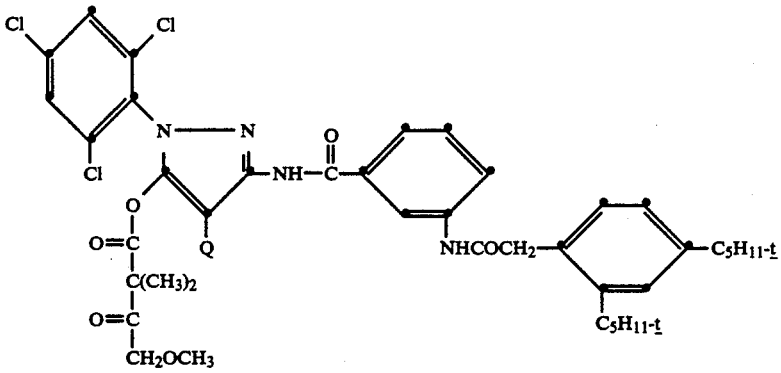

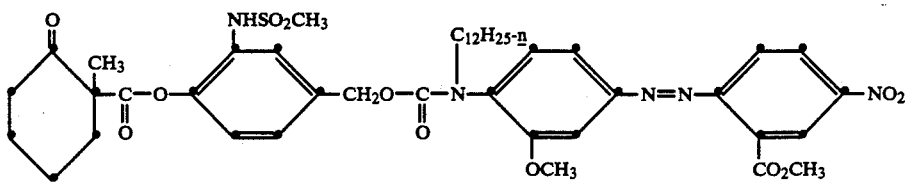

-continued
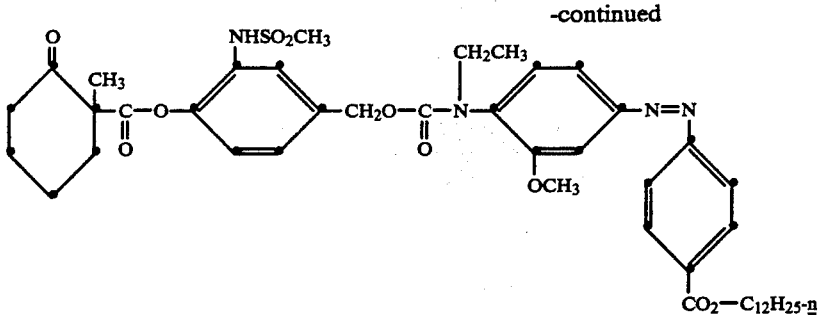
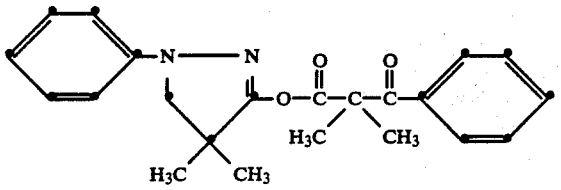
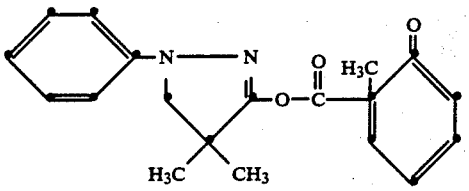
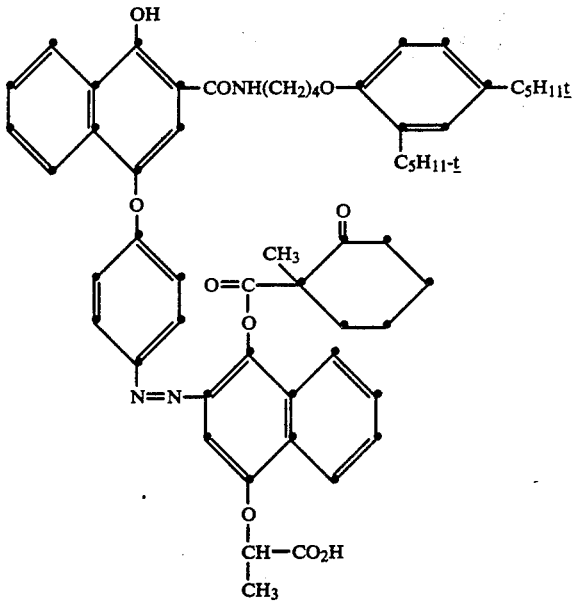
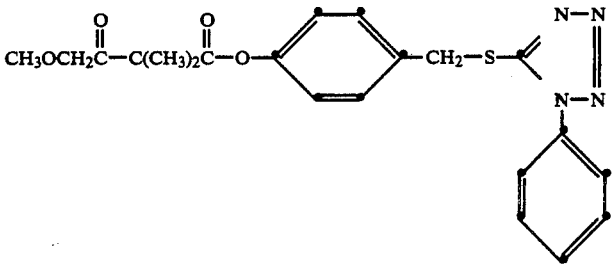
wherein Q is hydrogen or a coupling-off group.
8. A process of forming a photographic image in an exposed photographic element as defined in claim 1 comprising developing said element with a photographic silver halide color developing agent in the presence of a dinucleophilic reagent.
* * * * *